United States Patent [19]

Streicher

[11] 4,144,001

[45] Mar. 13, 1979

[54] ECCENTRIC WORM PUMP WITH ANNULAR WEARING ELEMENTS

[75] Inventor: Max Streicher, Oderstrasse 28, D-7988 Wangen, Allgäu, Fed. Rep. of Germany

[73] Assignees: Fördertechnik Streicher GmbH, Bad Schussenried; Max Streicher, Wangen, Allgäu, both of Fed. Rep. of Germany

[21] Appl. No.: 782,525

[22] Filed: Mar. 29, 1977

[51] Int. Cl.[2] ..... F01C 1/10; F01C 5/00; F01C 21/08; F01C 21/10

[52] U.S. Cl. ..... 418/48; 418/153; 418/178

[58] Field of Search ..... 418/48, 152, 153, 178, 418/220

[56] References Cited

U.S. PATENT DOCUMENTS

| | | | |
|---|---|---|---|
| 2,028,407 | 1/1936 | Moineau | 418/48 |
| 2,349,022 | 5/1944 | Ungar et al. | 418/201 |
| 2,462,924 | 3/1949 | Ungar | 418/201 |
| 3,229,643 | 1/1966 | Roudaut | 418/153 |
| 3,814,557 | 6/1974 | Volz | 418/201 |

FOREIGN PATENT DOCUMENTS

| | | | |
|---|---|---|---|
| 2259125 | 6/1974 | Fed. Rep. of Germany | 418/48 |
| 82160 | 7/1956 | Netherlands | 418/48 |
| 1238237 | 7/1971 | United Kingdom | 418/48 |

*Primary Examiner*—John J. Vrablik
*Attorney, Agent, or Firm*—Max Fogiel

[57] ABSTRACT

An eccentric worm pump in which a helical worm rotor rolls off in a planetary manner in a multi-thread hollow helix of a stator sleeve. The helix is adapted to its cross-section and its pitch. Closed helical cavities between the rotor and the opposite part of the helix, are formed and moved from an intake end to a delivery end of the stator sleeve. A plurality of interchangeable annular wearing elements are arranged staggered axially in the roll-off track between the rotor and the stator. The wearing elements may be in the form of collars fixed relative to one another and rotatably adjustable axially relative to the rotor. The collars are braced by a reset device attached to the free rotor end between ring shoulders. The collars have an outer surface which rolls off in the hollow helix and has a layer of elastically resilient wearing material. The wearing material is in the form of a wear-proof sliding synthetic substance.

39 Claims, 28 Drawing Figures

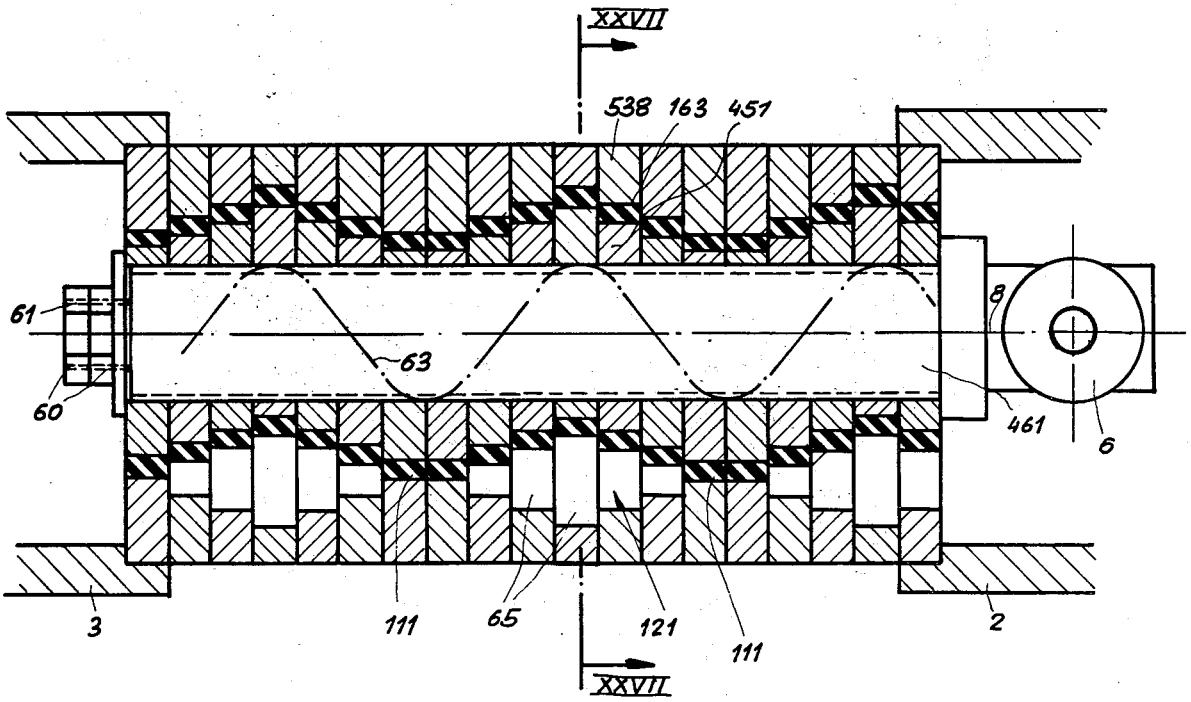

6
8
461
2

457
163
538
XXVII
111
121
XXVII
65
63
111
3
61
60

ECCENTRIC WORM PUMP WITH ANNULAR WEARING ELEMENTS

BACKGROUND OF THE INVENTION

The present invention relates to an eccentric worm pump with a helical worm rotor which rolls off in planetary fashion in a hollow helix, adapted to its cross-section and its pitch, of a stator sleeve. Between the rotor and the facing portion of the hollow helix, closed helical cavities are formed and are moved from an intake end to a delivery end of the stator sleeve.

Eccentric worm pumps are used for widely varying purposes, particularly for the delivery of pulpy highly viscous material and goods containing solid particles. They are self-aspirating and can generate relatively large pressures which depend on the ratio of stator length to pitch. The goods to be transported are partially crushed or homogenized, and solid particles are ground, or, if the stator is made of resilient material such as rubber, they are partially transported without undergoing change. From the roll-off process between rotor and stator, there result relatively large pressure and friction loads which frequently lead to very quick wear on the inside contour of the stator helix. Even with radial position of the stator sleeve, the wear is sometimes so large that the stator sleeve must be replaced after a very short period. The operating costs for the pumps are relatively large due to such repairs.

Accordingly, it is an object of the present invention to reduce the wear on eccentric worm pumps and to lower their operating cost.

Another object of the present invention is to provide an eccentric worm pump of the foregoing character which is substantially simple in construction and may be economically fabricated.

A further object of the present invention is to provide an eccentric worm pump, as described, which may be readily maintained in service and which has a substantially long operating life.

SUMMARY OF THE INVENTION

The objects of the present invention are achieved by providing that a large number of interchangeable annular wearing elements are staggered axially behind one another in the roll-off track between rotor and stator. While previously the construction was such that continuous worm surfaces mate with each other, here the continuous surface is subdivided at at least one of these two parts into individual radial disk planes, and individual replaceable wearing elements are provided in the disk elements. Aside from special cases, completely identical wearing elements, which can be produced in large quantities and hence cheaply, are sufficient; they can be replaced with little effort.

The replacement is particularly simple if the wearing elements constitute collars and can be axially fixed, but rotatably adjustable relative to the rotor. They can then be replaced without special expert knowledge. Since the collars can turn relative to the rotor, different roll processes resulting from radial displacements on individual locations of the rotor, from transported solid particles, etc. can be broken up into individual orderly roll-off processes, with the friction relative to the stator sleeve, and hence its wear being reduced considerably.

The collars can be held or braced by a readjustment device attached to the free rotor end between ring shouders relative to one another. If the collars are of resilient material, the wear of the collars can be compensated by resetting and one or several wearing rings can be pulled on from time to time.

Depending on the application, it may be advantageous if the collars have, at least on their outside surface which rolls off in the hollow helix, have a layer of elastically resilient wearing material. In this manner, the entire resilience necessary for transporting solid particles can be shifted to the collars; i.e., the stator may be of hard wearproof material. At this time, a wearproof sliding synthetic material, particularly polytetrafluoroethylene (PTFE) is preferred as wearing material.

According to another suggestion, a preferably coherent layer of wearing material is placed on the inside and outside surface at at least one side surface of the collars. This is of special significance when using sliding wearing materials since this facilitates the sliding of these collars against one another, against the rotor and against the stator.

With the simplest design, the collars are completely made of such material. They may be cross-arched on the inside and outside for adaptation to the curved surfaces of stator and rotor; e.g., O-rings of circular cross-section are suited for this purpose. If the collars are made of easily deformable material, or of a material which slides better against metal, they may be joined axially by alternate metal spacer rings.

In another embodiment, there are collars of at least two ring elements held against each other, of which at least one is made of metal and one, at at least one boundary surface, is of wearing material. For example, a metal core ring may be surrounded at all sides by wearing material.

Preference is given to a core ring with rectangular cross-section which is enclosed by an annular sleeve with barrel-shaped outside cross-section. The core rings then can be made by sliding from a cylindrical pipe, and the ring center has on the inside and outside a relatively thick cushion of wearing material, while the face surfaces are held plane and provide through large-area contact, improved relative adjustment and sealing.

The manufacture of the enclosure can be simplified if an enclosure ring of wearing material has a lateral ring opening, bounded by retaining rims, for subsequent insertion of the core ring, where preferably one side surface of the core ring projects at least into the outer side surface of the collar, and hence wearing material and metal slide against each other there.

The core ring may have, e.g., a T-shaped cross-section, with the flange ends enclosed by the retaining rims, and the stringer end projecting into the associated side surface of the collar. Core ring and enclosure ring may also have a barrel-shaped cross-section, with the core ring laterally shifted relative to the enclosure ring. Then the axial holding force is reduced in one direction so that a subsequent joining by vulcanizing, gluing, etc. may be used.

In one embodiment, a collar has at least two coaxial, nestled and mutually rotatable ring elements. The rotary adjustment is placed inside the collar, hence the inner ring element can be seated rigidly.

A core ring can be placed between two enclosing rings enclosing it from the outside or inside in U-shaped fashion. The core ring is rotary adjustable relative to at least one of these enclosure rings, may be solidly connected to the other, and is completely closed-off from the outside.

A collar may comprise two metal bearing rings aligned by guide surfaces; these bearing rings may possibly support each other on one side through a ring shoulder.

The sliding friction during the roll-off process can be replaced by a rolling friction if the collar has a collar arrangement with rolling bodies distributed over its periphery, such as balls, rollers or barrels. This is relatively easy when a collar is constructed as a race of wearing material for the rolling bodies. Then, it is only necessary to provide in the collar suitable recesses for the rolling bodies which roll off directly on rotor and stator. The friction losses are considerably reduced in this manner. Also, a metal race may be embedded in the wearing material of the collar.

In another embodiment, complete roller bearings with metal, laterally sealed inside and outside surfaces are provided. If inside and outside surface of the roller bearings are properly arched, they may again run directly between smooth curved surfaces of rotor and stator.

The bearings may also be attached to stepwise laterally staggered ring surfaces of the rotor. If the rotor itself is one piece, a crosswise divided or elastically deformable seating ring would have to be attached between inside ring and seating surface in order to facilitate sliding the inside ring over the steps.

The rotor may also be made up of individual cylindrical rotor disks whose thickness is adapted to the bearing width; with each disk being rotated relative to the adjacent disk by a constant index angle. The disks must then be somehow centered relative to the rotor axis, and, after adjustment, must be fixed so that they may be rotatably adjustable. For example, the rotor disks can seat with an eccentric drillhole on a cylindrical shaft located in the rotor axis and may be fixed to it rotationwise; in particular, they engage a helical keyway of the shaft with an internal key head. With thick disks it might be expedient, to angle the key heads to correspond to the helical pitch. The disks can always be manufactured very cheaply by a simple or at most twofold punching operation or by broaching, and can then be assembled into a rotor of any length.

Instead of or in addition to the collars or collars, the inside surface of the stator sleeve may contain successively individual elliptical wearing rings attached to the helix cross-section, for example, in inwardly open grooves of the stator sleeve. If the stator sleeve in a known manner comprises individual annular stator disks rotated relative to one another by an index angle, it is recommended that alternately first stator disks with a smaller and second stator disks with a larger elliptical perforation be used, thus holding the wearing rings.

The first stator disks may then have wearing material at least on the inside, unless they are completely made of such material. Preferably, the wearing rings are placed in the plane of the second stator disks between the first stator disks. When such wearing rings are made of deformable material, they may be taken out as long as the tension between the stator disks is sufficiently reduced.

The material of such wearing rings or the ring material of the collars can be chosen arbitrarily, depending on the requirements. If quiet operation and the transport of solid particulars without comminution is desired, elastically deformable material should be used. When solid particles are to be ground or crushed, hard abrasive material such as powdered metal etc. must be used. One can use wearing rings and/or collars of different material in the same pump and, by interchanging of such rings, can switch the pump, otherwise unchanged, from one application to another.

Preference is given at this time to an embodiment where rotor and stator are made of equally wide disks where collars placed on the rotor disks have cylindrical inside and outside surfaces. The rotor disks may be held by a multi-edge profile of ribs and grooves distributed at equal intervals on the periphery to rotate with a shaft concentric with the rotor axis. Only this shaft and possibly tie rods necessary for bracing the rotor must be set aside for the required pump length. Then the pump can be quickly assembled from the inexpensive disks and collars as required; the sealing between adjacent steplike bounded helical cavities takes place on partially cylindrical surfaces.

The multi-edge (polygon) profile may run helically and may have the same pitch as the rotor helix. All rotor disks are attached to the shaft in the same initial position and are screw-mounted on it. The polygon profile may also run parallel to the rotor axis if the graduation of its ribs and grooves equals the ratio of the disk width to pitch.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
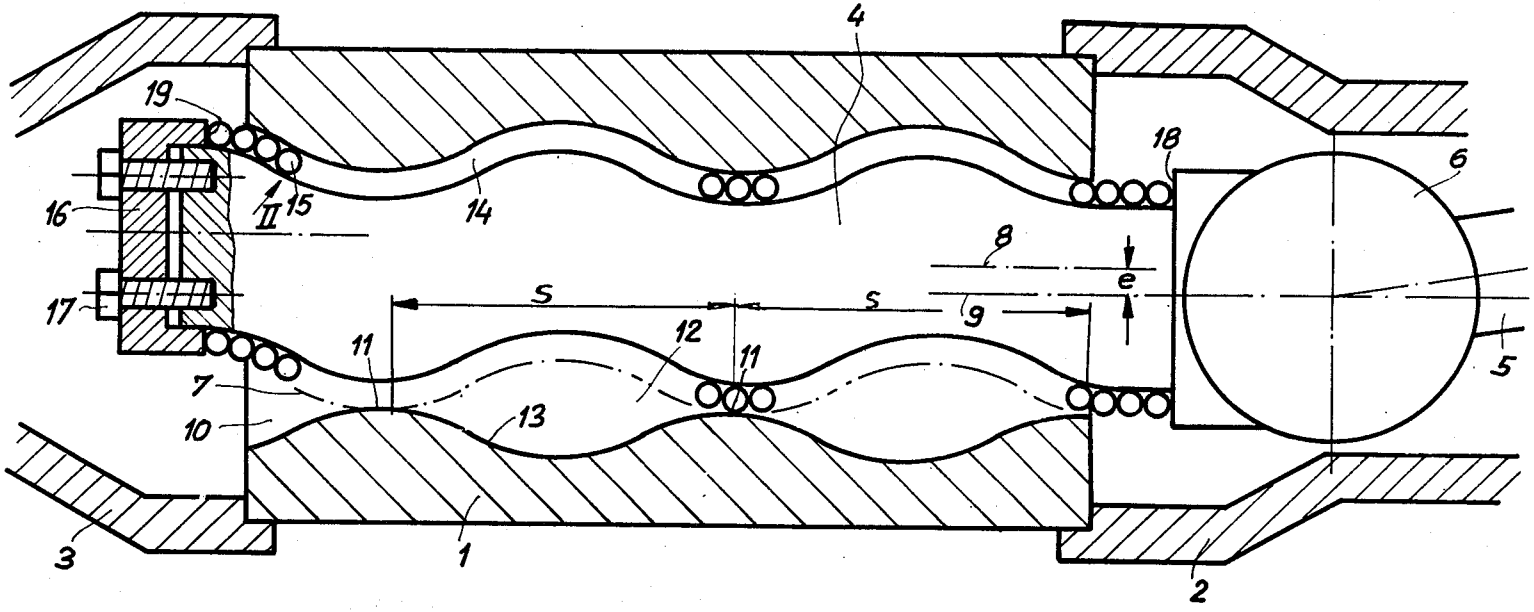
FIG. 1 is a lengthwise section taken through an eccentric worm pump.

In the eccentric worm pump shown in FIG. 1, an outwardly cylindrical stator sleeve 1 is braced by tie rods (not shown) between an intake pipe stub 2 and a delivery pipe stub 3. The worm rotor 4 is driven by a universal-joint shaft 5 via an omnidirectional joint 6. It normally has the outside contour 7 of a single-thread worm with circular cross-section and rolls in an epicyclic manner with eccentricity e of its rotor axis 8 relative to the stator axis 9 in a double-threaded hollow helix 10; between the sealing joints 11, spaced at pitch width s helical cavities are formed which normally migrate from intake pipe stub 2 to the delivery pipe stub 3.

A pure roll-off process takes place at the inside contour 13 of the hollow helix. Therefore, both contour surfaces may be made of hard materials as long as the sealing at 11 is ensured. This is the case, for example, when lubricating and sealing viscous liquids without coarse impurities are to be delivered. However, when large-size hard solid particles are enclosed by the flow medium, some flexibility must be provided to which end the stator sleeve until now was made of rubber-like flexible material. When such solid particles pass the sealing locations 11 which migrate in the lengthwise direction, there develop extremely large pressure forces and additional friction forces so that the inside contour 13 wears quickly. Even adjustment devices for radially pressing together the deformable stator sleeve can prolong its life only for a short time, so that the sleeve must be replaced after a few months.

According to FIG. 1, a hose-like wearing jacket 14, comprising O-ring shaped collars 15, is inserted between the inside contour 13 of the hollow helix 10 and the smaller diameter worm rotor 4. These collars are successively pulled onto the rotor and held on its free end by a pot-shaped end cap 16 by means of screws 17, which can be reset, between shoulders 18 and 19. They can turn relative to each other and relative to the rotor and thus they can roll off along the inside contour during the roll-off movement.

Of course, it is possible to make the stator sleeve 1 from elastic deforming or resilient material. This applies particularly if the collars themselves are made of such elastically deformable material, since then during passage of solid particles, the local peaks of pressure and friction forces are reduced considerably. The harder the stator material, the more the wear is shifted to the collars 15. One could, for example, make the stator sleeve 1 of relatively hard rubber, and the collars 15 of the rubber ordinarily used for O-rings. This would maintain the readjustability of the stator sleeve, its life would be lengthened several times over, and only the collars 15 need be replaced from time to time. Quite some time passes before such a replacement is necessary, since with decreasing tension or decreasing sealing effect, additional collars 15 may be installed and tightened by cap 16.

By shifting the wear to the collars 15, the stator sleeve can be made of any hard and wear-resistant material or can be coated on the inside with such material so that the stator sleeve is not exposed to noticeable wear. The material quantity for the collars is one-tenth that for the stator sleeve.

The necessary and possibly more expensive special material can be used for the collars; depending on the medium being delivered by the pump, the sealing effect or flexibility, the wear and the comminution are important. If the comminution (size reduction) is most important, abrasive materials such as powder metal or solid hard steel may be used. If sealing, gliding ability and low-noise are paramount, high-grade synthetics such as polytetrafluor ethylene can be used. Also, the resistance to chemical reactions may be important in selecting the material. It is also possible to use different collars simultaneously. After a given operating period, collars of larger outside diameter may be introduced till finally all the material of the stator sleeve is used up.

It is not even necessary to machine the inside contour 13 of the stator sleeve so that it may be cast, as gray cast iron or steel casting, using collars made of abrasive material, with additional abrasive agents, in order to smooth the inside contour 13.

Since the worm rotor extends beyond the ends of the stator sleeve, its inside edges 20 should be rounded off. This rounding can be renewed from time to time as the stator sleeve wears down.

If the collars 15 are made of materials which slide against each other with undesirable effects, they can be axially joined alternating with spacer rings 21. These spacer rings can also produce comminution processes.

Figure 4:
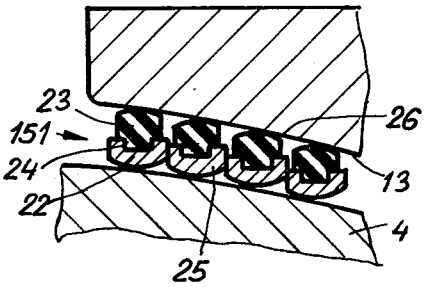
FIG. 4 is an embodiment with a two-part collar.

According to FIG. 4, collars 151 are subdivided into inside rings 22 and outside rings 23. These rings can be rigidly connected to one another, or may be rotatable relative to one another along the separating surface 24. The separating surface here is a tongue-and-groove arrangement to safeguard against axial shift. For example, the inside ring 22 may be made of metal and pressed on and thus sit in a sealing manner on the rotor, while the outside ring 23, made of PTFE or other resilient synthetic or rubber can be pulled over with deformation, is resilient and adheres to the inside contour 23 in a sealing manner and slides along the separating surface 24. Inside surface 25 and outside surface 26 of these collars are so heavily cross-arched, that they will adapt to all curvatures of contour 13 and of the outside surface of the rotor shaft.

Figure 5:
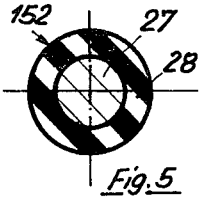
FIG. 5 shows a cross-section of a collar with a coated circular core ring.
Figure 6:
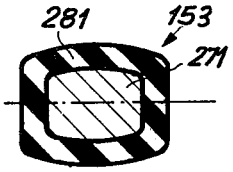
FIG. 6 shows a section through a collar with barrel-shaped cross-section.

With collar 152 of FIG. 5, a core ring 27 of circular cross-section is surrounded by a ring jacket 28 of suitable wearing material. With collar 153 in FIG. 6, the core ring 271 has a barrel shaped cross-section and is enclosed in a sleeve 281 of wearing material. For example, this jacket may have a greater thickness on the outside than on the other three sides.

Figure 7:
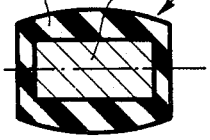
FIG. 7 shows a section through a collar with rectangular core ring cross-section.

Thus, the collar of FIG. 7 has a core ring 272 with rectangular cross-section which makes possible a particularly simple manufacture by cutting from a cylindrical pipe. The jacket 282 is strengthened by the curvature on the outside and inside in cushion-like fashion; the outer layer may possibly be thicker than the inner layer.

Figure 8:
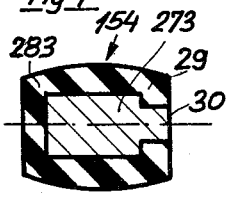
FIG. 8 shows a section through a collar with T-shaped core ring cross-section with exposed side surface of the flange.

With collars of FIGS. 5 and 7, ring and jacket may be connected in one piece by the jacketing. According to FIGS. 8 and 9, these parts can be produced separately and then joined, which does not preclude from being permanently joined later by vulcanization. The core ring 273 of FIG. 8 has a T-shaped cross-section, and the jacket 283 of this collar 154 has a U-shaped cross-section, reaches with the inward projecting flanges of its retaining rims 29 around the flange ends and encloses the stringer so that its end surface 30 projects at least to the common side surface. In this ring zone, the material of the core ring can glide on the material of the jacket of the adjacent collar.

Figure 9:
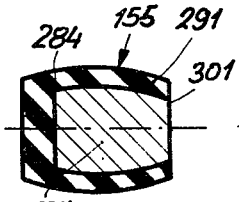
FIG. 9 shows a section through a collar of FIG. 6 with exposed side surface of the core ring.

The collar 155 of FIG. 9, like its core ring 274, has a barrel shaped cross-section, laterally exposing an end surface 301 of the core ring. There, the axial holding force of the retaining rims is relatively small so that a solid connection made subsequently of the core ring 274 to jacket 284 is recommended.

Figure 10:
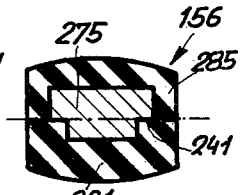
FIGS. 10 to 12 shows cross-sections through slide bearing collars.

The collar of FIG. 10 also has a barrel-shaped cross-section; the inside ring 221 corresponds to the inside ring 22 of FIG. 4. The separating surface 241 has about the same shape, but is formed between a T-shaped core ring 275 with a U-shaped jacket 285. This jacket can be connected rigidly or loosely or rotatably to the core ring. In any case, it can be rotated relative to inside ring 221 in order to perform a small roll-off movement on the rotor.

Figure 11:
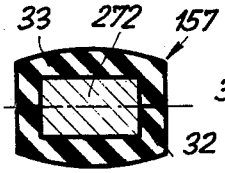

According to FIG. 11, with collar 157 a metallic core ring 272 is completely enclosed by two ring caps 32, 33 which have a U-shaped cross-section. It can be rotary-adjustable relative to one or both ring caps.

Figure 12:
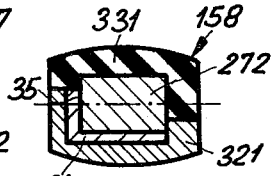

With collar 158 of FIG. 12, the core ring 272 with a bearing ring 34 of angular cross-section, forms a metallic journal bearing. Both rings are also enclosed by U-shaped ring caps 321 and 331 of wearing material. The core ring 272 may be made of steel, the bearing ring 34 may be of suitable bearing material such as bronze. The axial pressure occurring during operation in one direction is metallically transmitted by the lateral shoulder 35.

Figure 13:
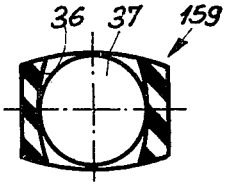
FIGS. 13 to 15 show cross-sections through collars developed into roller bearing races.

The collar 159 of FIG. 13 of elastically resilient wearing material has recesses 36 for hardened steel balls 37 distributed at equal intervals along the periphery. The recesses 36 may be through-going cylindrical drillholes of smaller diameter than the steel balls 37 so that these balls are held under light spring pressure in the wearing material, but otherwise roll directly between rotor and stator. The steel balls can take on the comminution function, while the wearing material does the sealing.

Figure 14:
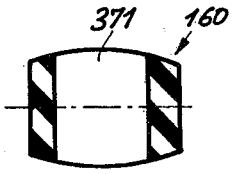

The collar 160 of FIG. 14 is essentially similar except that barrel-shaped roll bodies 371 are used.

Figure 15:
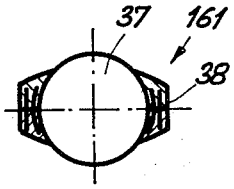

With collar 161 of FIG. 15, the steel balls 37 are held in a metal race 38, with the space between the outside surfaces of the metal race and the steel bearings filled by wearing material. This should take place in such a way that the steel balls do not seize the wearing material. Therefore, they should be coated with a suitable separating material before being inserted.

Figure 16:
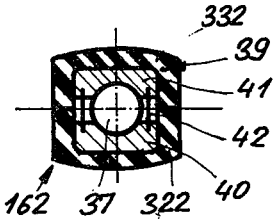
FIG. 16 shows a collar with a roller bearing jacketed on the inside and the outside.

The collar 162 of FIG. 16 has a standard ball bearing 39 with steel balls 37, between inside ring 40 and outside ring 50, and lateral seals 42. For adaptation to the smooth-surfaced contours of rotor and stator, there are ring caps 322 and 332 which provide additional side sealing.

Figure 17:
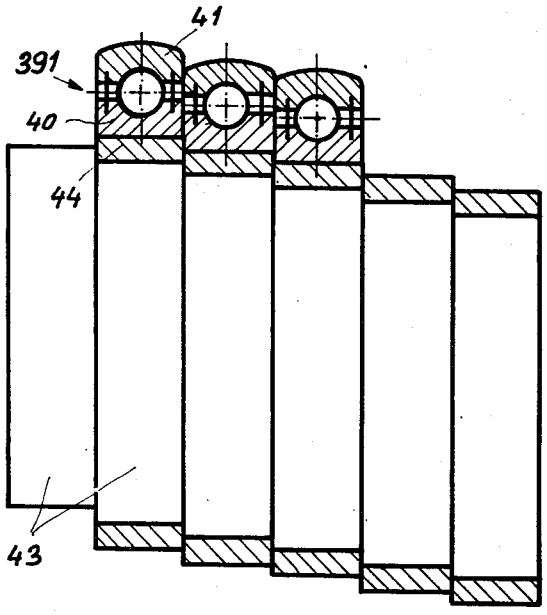
FIG. 17 shows partial cross-section through a worm rotor with stepwise arranged cylinder surfaces and roller bearings installed over intermediate rings.

So far, rotor and stator had continuous helical surfaces. According to FIG. 17, the rotor in accordance with its helix curve is divided into stepwise joined cylindrical seating surfaces 43 for holding ball bearing collars 391, with the outside ring 41 having cross arched outside surfaces. So that the inside ring 40 can be slid onto its seating surface, a separate seating ring 44 must be interposed. Such a seating ring may be formed, for example, by a metal ring split into two half-rings or may be made from a resilient material such as rubber which can be slid over the shoulder surfaces onto the seating surface. The outside ring 41, when the stator is of rubberlike material, can roll off immediately on its inside contour, or a ring cap can again be attached; the cap envelope of FIG. 16 can be used in the embodiment of FIG. 17.

Figure 18:
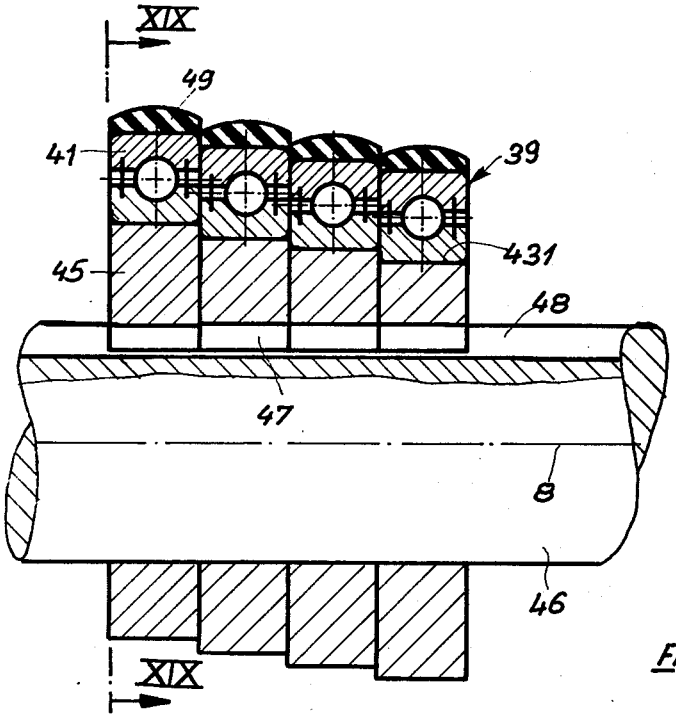
FIG. 18 shows a partial lengthwise section through a worm rotor comprising individual joined rotor disks with installed ball bearings.
Figure 19:
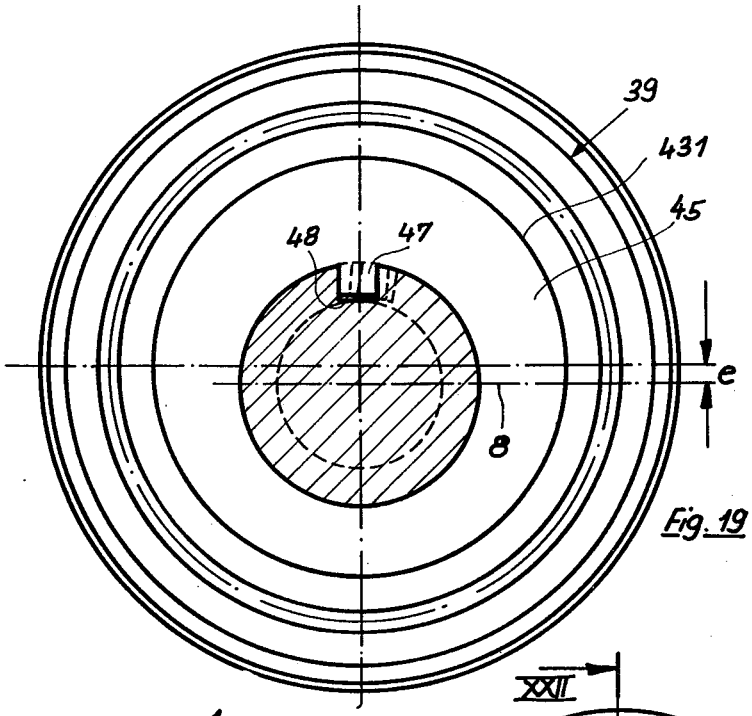
FIG. 19 shows a section taken along line IX—IX in FIG. 18.

The seating surface design makes is possible to divide, in accordance with FIGS. 18 and 19, the rotor into individual cylindrical rotor disks 45 which must only be pivoted corresponding to the arrangement of seating surfaces 431 about their eccentric shaft drillhole. These disks may be connected individually by screws etc. provided along the periphery. However, it is better if they are placed with an eccentric drillhole on a shaft 46 concentric with the rotor axis 8 and engaged with a key head 47 in a helical keyway 48 in the shaft. Of course, instead of a single keyway, several smaller grooves can be uniformly distributed over the shaft periphery, and instead of the key head 47, several smaller internal projections may be provided. The disks 45 can always be produced in large quantity as punched parts. The ball bearings 39 are installed without change and can be pulled on without interposed seating rings. If they are to turn directly on the inside contour of the stator helix, the outside rings 41 may be enclosed by an arched layer 49 of wearing material.

Figure 20:
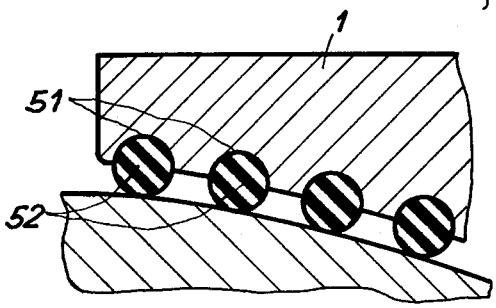
FIG. 20 shows a partial section similar to FIG. 2 through an embodiment with wearing rings located in the stator sleeve.

Wearing rings must not necessarily and exclusively be attached to the rotor, but may equally well be installed on the stator sleeve in accordance with FIG. 20. There, at the inside wall surface of the hollow helix there are semicircular annular grooves 51 with which wearing rings 52 with circular cross-section are attached. The wearing rings themselves must be oval elliptical according to the hollow helix, and must be able to take frictional forces in the peripheral direction. They are therefore fixed in grooves 51, e.g., glued in. If possible they should have sufficient stiffness to be held in their shape.

Figure 2:
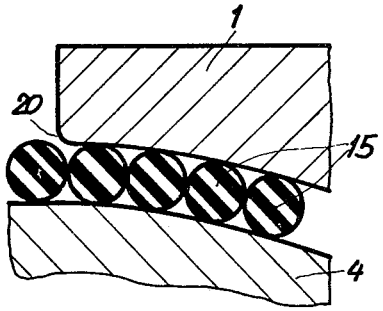
FIG. 2 is an enlargement of region II in FIG. 1.
Figure 3:
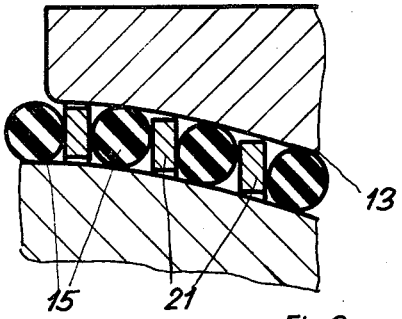
FIG. 3 is a view corresponding to FIG. 2 of a modified embodiment.
Figure 21:
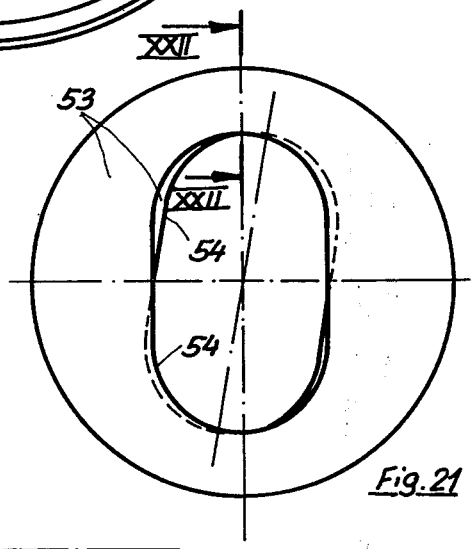
FIG. 21 shows a front view of a stator sleeve composed of several ring disks.
Figure 22:
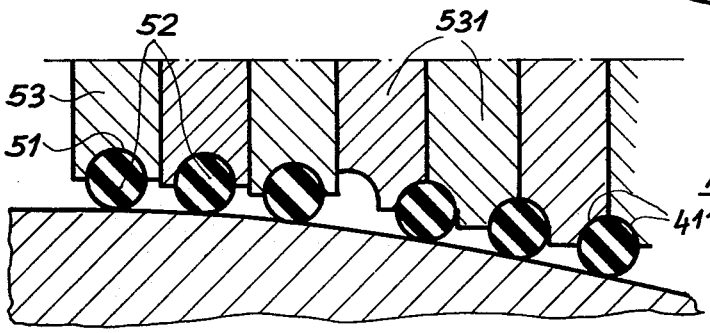
FIG. 22 shows a section taken along line XXII—XXII in FIG. 21.
Figure 23:
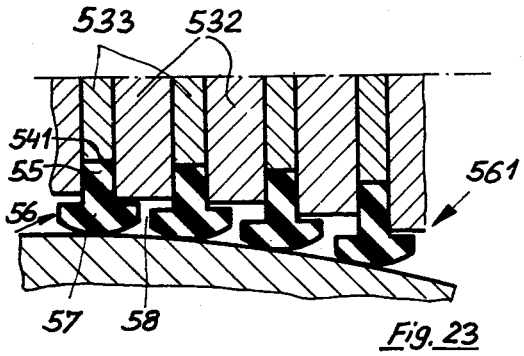
FIGS. 23 to 25 show partial sections corresponding to FIG. 22 through modified stator arrangements.
Figure 24:
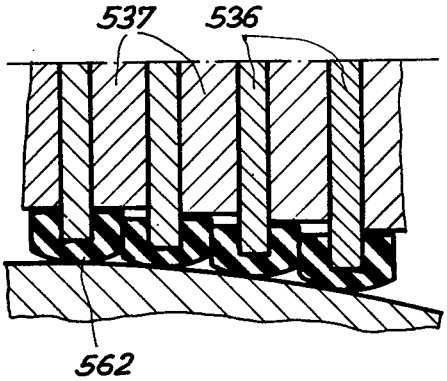

According to FIGS. 21 and 22, the stator sleeve is formed by individual indentical annular stator disks 53 which have an elliptical perforation 54 corresponding to the cross-section of hollow helix 10. The annular grooves 51, as shown on the left of FIG. 22, can be attached to the middle of each stator disk; or, as shown on the right-hand side of FIG. 2, each stator disk 531 has on the inside on the rims annular grooves 411 which may extend over angles from ninety to hundred and twenty so that the wearing rings 52 can be clamped between adjacent stator disks. Such wearing rings then must no longer be inserted in their annular grooves by plastic deformation, but may be rigid and made out of any material. According to FIG. 23 they may have any cross-section. There, first stator disks 532 and second stator disks 533 are joined, with the perforations 541 of the second annular disk 533 larger than perforations 54 of the first annular disks. Between these, the narrower outer rim 55 of wearing rings 56 can be clamped; these rings 56 have, e.g., a mushroom-shaped cross-section inside bead 57 and leave annular spaces 58 empty between them. The wearing rings 561 shown on the right of FIG. 3 has essentially a T-shaped cross-section and are close together. Similarly, close together are the U-shaped cross-section wearing rings 562 between the first stator disks 536 and the second stator disks 537 in FIG. 24.

In this manner, wearing rings provided at the stator and collars attached to the rotor can be combined according to the required operating conditions, without stator and rotor themselves being subject to any wear. The life of the pump is thus unlimited if wearing rings and collars are replaced from time to time.

Figure 25:
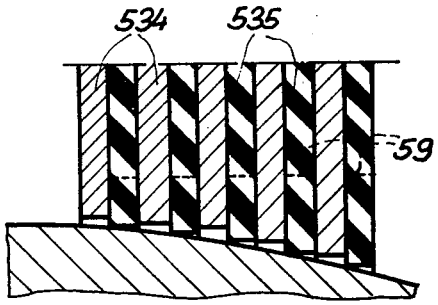

FIG. 25 shows the possibility of combining metal stator disks 534 with stator disks of wearing material, with the latter stator disks projecting a little more towards the inside. These stator disks may be made of a low-friction synthetic material such as Perlon or PTFE and on the cylinder surface 59 there may be a division into outer stator disks of sheet steel and inner ring disks of wearing material.

Figure 27:
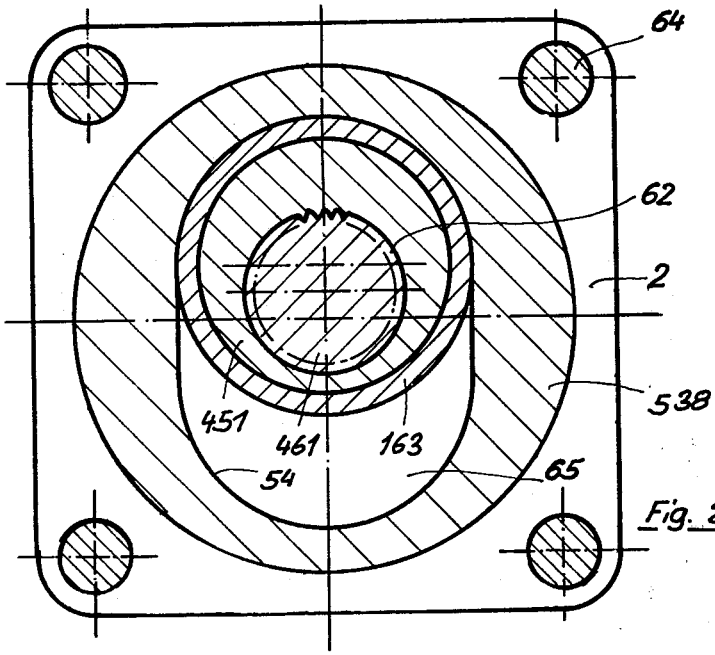
FIG. 27 shows a section taken along line XXVII—XXVII of FIG. 26.
Figure 26:
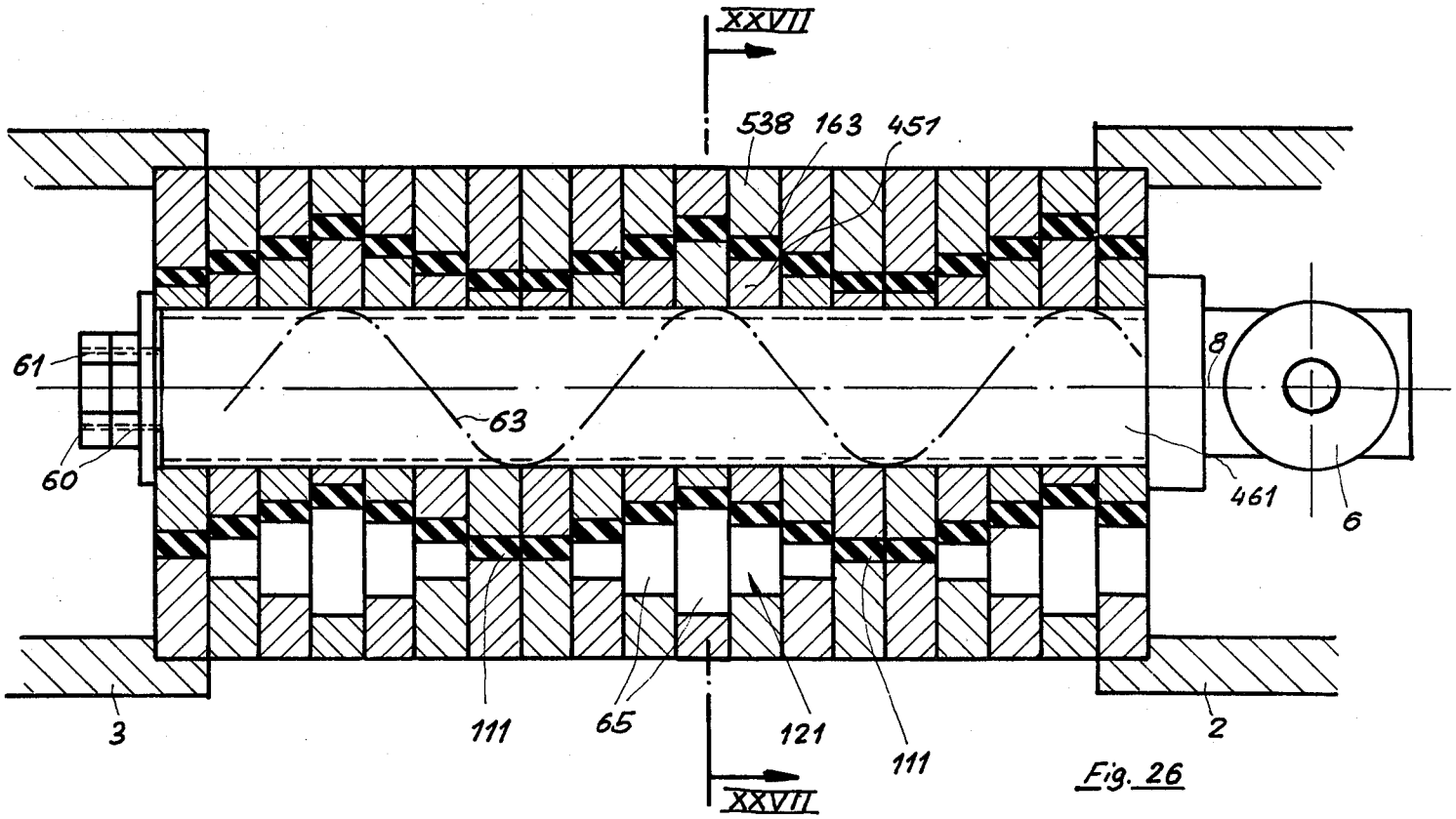
FIG. 26 shows a lengthwise section, similar to FIG. 1, through an eccentric worm pump assembled from equally wide rotor and stator disks.

With the embodiment shown in FIGS. 26 and 27, rotor and stator are divided into individual, equally wide annular rotor disks 451 and stator disks 538 with a continuous cylindrical shaft 461 and cylindrical annular collars 163. The rotor disks 451 are braced against one another and against one shoulder of the shaft by nuts 60 which are screwed to the threaded end 61 of shaft 561. The outside surface of the shaft is provided in the manner of a helical gear along the entire circumference with a knurled pattern which is preferably formed by triangular teeth. The same knurled pattern is attached to the inside surface of disks 451 and can be achieved by a helical punch or broaching process. The screw pitch corresponds, according to the sine curve 63, to the pitch of the mean worm helix of the rotor. Hence, all disks 451 can be screwed to the disks and to the shaft in the same alignment position, which can be determined by marks on the disks and on the shaft. Individual pump planes made up of rotor disks 451, collar 163 and stator disk can be successively assembled. At any rate, the collars should be assembled simultaneously with the rotor disks 451. The stator disks 538 can also be placed later with their elliptical perforations 54. They are subsequently braced by tie rods 64 between intake pipe stub 2 and delivery pipe stub 3 or between separately attached end flanges, after the stator disks have aligned themselves via the collars in the peripheral direction on the rotor. If necessary, a cylindrical sleeve can be pulled over the stator disks for radial centering.

Here several sickle-shaped cavities bounded by radial planes can be joined, displaced against one another by an indexing angle, and thus form steplike cavities 121 which in the lengthwise direction are separated from one another by at least one partially cylindrical sealing location 111. While rotor and stator disks are punched from sheet steel, the material for the collars is a suitable wear-resistant synthetic, conforming to the application purpose. These collars may also be made of metal, e.g. bearing material such as bronze or several different materials as previously described.

Instead of the helical knurled pattern 62, one may use a pattern running parallel to the shaft axis, if the division of the individual teeth corresponds to the division resulting from the width of the disks. It is only necessary to slide on the rotor disks 451 displaced by an index (division) angle. Likewise, the engagement with a single helical keyway, described in FIGS. 18 and 19, may be used.

The advantage of the above-described embodiment is that only the relatively simply made shaft 461 and the tie rods 64 have to be adapted to the pump length. Rotor and stator disks, like the collars, can be stored in large quantities and then assembled, as required, to the desired pump length. Through the width of the partial cylindrical sealing surfaces, extraordinary wear protection and hence an appreciable increase in operating life is achieved with a single set of collars.

Figure 28:
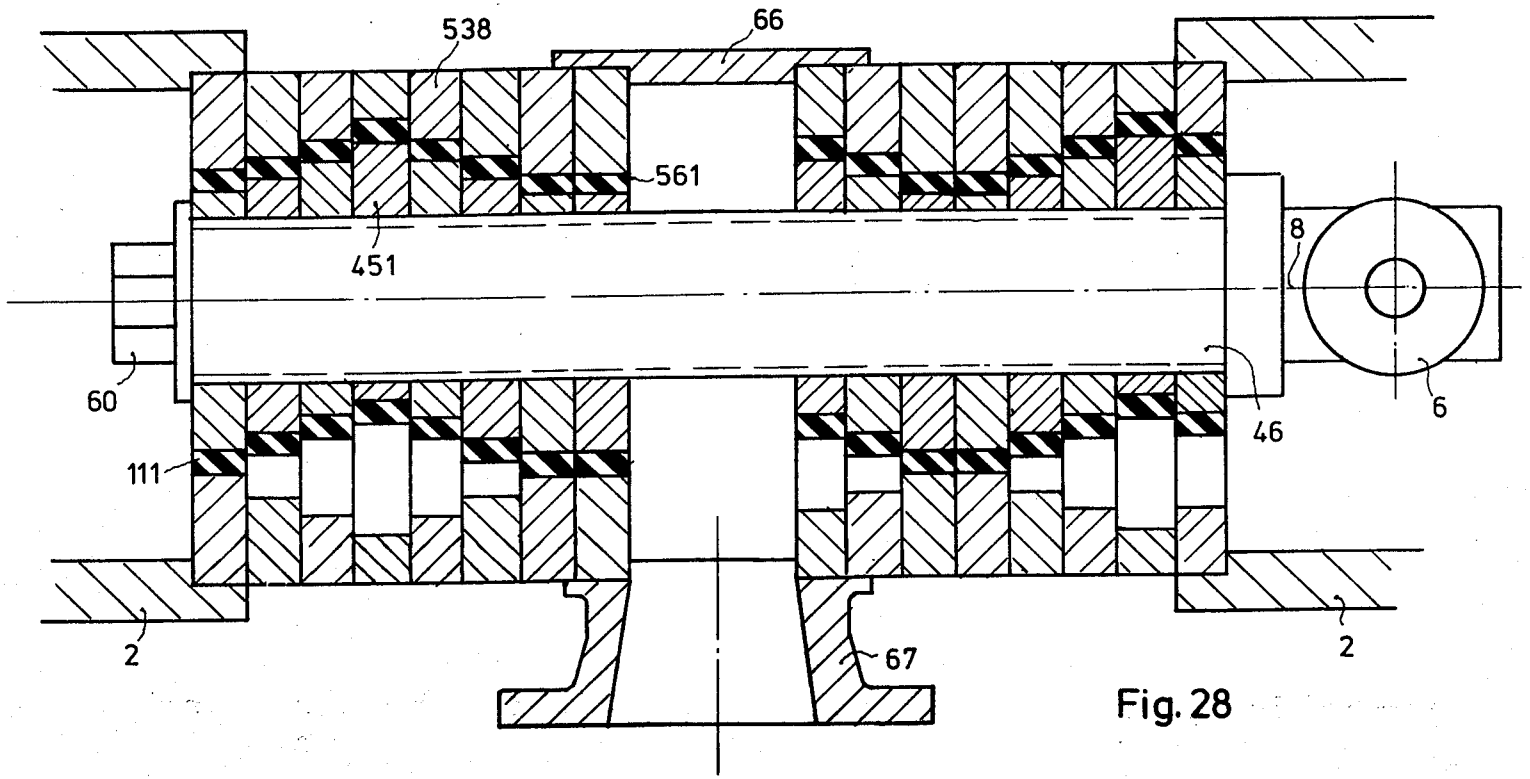
FIG. 28 is a lengthwise sectional view of FIG. 26 through a double pump.

FIG. 26 differs from FIG. 28 only in the respect that each set or unit of disks is subdivided into two individual units. Between these units is a ring-shaped bushing 66 held by tubular elements. With this arrangement, it is possible to convey double the quantity upon substantially little variation in the pressure relationships, in the rotational direction of two outer tubular elements 2 to tubular elements 67 serving as outlet, or in the reverse manner from the tubular elements 67 to both outer tubular elements 2.

In order to avoid wear losses between rotor and stator disks, it is advantageous, for example, to taper the rotor disks from their seat on the shaft 46 to the exterior. From short hub, the outer side surfaces can be set back approximately 0.2 or 0.3 mm. At the same time, the sliding rings 561 have substantially the same width as the stator disks 538. As demonstrated experimentally, no pressure losses are incurred therefrom. Instead, considerable higher operating pressures are realized then with the conventional eccentric worm pumps.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An eccentric worm pump comprising, in combination: a helical worm rotor having step-shaped staggered ring surfaces; a stator; said helical worm rotor rolling off planetarily in a multi-thread hollow helix formed by step-shaped staggered loop surfaces of said stator; said helix being adapted to the cross-section and pitch thereof; helical cavities between the rotor and the opposite part of the helix being formed and moved from an intake end to a delivery end of said stator; a plurality of interchangeable annular wearing elements in a roll-off track between rotor and stator, said interchangeable annular wearing elements being arranged axially staggered; said wearing elements comprising collars axially supported by said rotor and rotatably adjustable relative to one another and to said rotor; said step-shaped staggered ring surfaces of said rotor, said annular wearing elements and said step-shaped staggered loop surfaces of said stator having substantially equal widths, said wearing elements rolling in curvature of the stator and rotating on said rotor.

2. The eccentric worm pump as defined in claim 1 including reset means for holding said collars, said rotor having a free end, said reset means being attached to said free end of said rotor between ring-shaped shoulders.

3. The eccentric worm pump as defined in claim 1 wherein said collars are cross-arched on their interior and exterior.

4. The eccentric worm pump as defined in claim 1 including a transversely divided seating ring located between the colars and rotor surfaces.

5. An eccentric worm pump as defined in claim 1, wherein said rotor is comprised of individual cylindrical rotor disks, said stator sleeve comprising individual annular stator disks staggered relative to one another by an index angle, said rotor disks having the same width as said stator disks and as said collars, said rotor disks having a cylindrical outer surface, said stator disks having an oblong inner surface conforming to said cylindrical outer surface.

6. An eccentric worm pump as defined in claim 1, wherein said rotor is comprised of individual cylindrical rotor disks, said stator sleeve comprising individual annular stator disks staggered relative to one another by an index angle, said rotor disks having the same width as said stator disks and as said collars, said rotor disks forming a cylindrical outer surface, said stator disks forming an oblong inner surface conforming to said cylindrical outer surface, said rotor having a shaft with a threaded end, said rotor disks being held against one another and against one shoulder of said shaft by threaded nuts on said threaded end of said shaft, the external surface of said shaft having a multi rip surface with key rips distributed along the circumference of said shaft, said rotor disks having inside surfaces corresponding also to said multi rip surface, individual pump elements being comprised each of a rotor disk, a collar and stator disk, said pump elements being successively assemblable, said stator disks having elliptical perforations and being held by tie rods.

7. The eccentric worm pump as defined in claim 1 wherein said collars comprise further elastically resilient wearing material at least on their outer surface rolling off in the hollow helix.

8. The eccentric worm pump as defined in claim 7 wherein the wearing elements comprise a wear-proof sliding synthetic material, particularly polytetrafluor ethylene (PTFE).

9. The eccentric worm pump as defined in claim 7 including a coherent layer of wearing material on the inside and outside surface and on at least one side surface of said collars.

10. The eccentric worm pump as defined in claim 9 wherein said collars are comprised exclusively of wearing material.

11. The eccentric worm pump as defined in claim 9 wherein said collars comprise metallic spacer rings alternately assembled axially.

12. The eccentric worm pump as defined in claim 7 wherein said collars comprise at least two ring elements held to each other, one of said ring elements being of metal, and one of said ring elements having at least a boundary surface of wearing material.

13. The eccentric worm pump as defined in claim 12 including a metallic core ring enclosed on all sides by wearing material.

14. The eccentric worm pump as defined in claim 13 including a ring-shaped sleeve with barrel-shaped outer cross-section, said ring-shaped sleeve enclosing said core ring, said core ring having a substantially rectangular cross-section.

15. The eccentric worm pump as defind in claim 13 including an enclosure ring of wearing material and having a lateral annular opening; retaining rims; said opening being bounded by said retaining rims for subsequent insertion of said core ring.

16. The eccentric worm pump as defined in claim 15 wherein said core ring has a side surface projecting at least into the outer side surface of said collar.

17. The eccentric worm pump as defined in claim 16 wherein said core ring has a T-shaped cross-section, said core ring having flange ends grasped by said retaining rims, the longitudinal portion of said T-shaped cross-section projecting to an associated side surface of said collar.

18. The eccentric worm pump as defined in claim 16 wherein said core ring and enclosure ring have barrel-shaped cross-sections, said core ring being displaced relative to said enclosure ring.

19. The eccentric worm pump as defined in claim 12 wherein said collars have at least two coaxial nestled ring-shaped elements rotatable relative to one another.

20. The eccentric worm pump as defined in claim 19 including a metallic core ring enclosed on all sides by wearing material; and two enclosure rings; said core ring being located between two enclosure rings, said enclosure rings enclosing said core ring in a U-shaped manner.

21. The eccentric worm pump as defined in claim 19 wherein said collars have two metal bearing rings aligned by guide surfaces.

22. The eccentric worm pump as defined in claim 21 including bearing rings held together on one side by a ring shoulder.

23. The eccentric worm pump as defined in claim 1 wherein said collar has a roller bearing arrangement with roll-shaped members distributed over its periphery.

24. The eccentric worm pump as defined in claim 23 wherein said roller-shaped members comprise roller bearings with metallic laterally sealed inside and outside rings.

25. The eccentric worm pump as defined in claim 23 including a collar comprising a race of wearing material for said roll-shaped members.

26. The eccentric worm pump as defined in claim 25 wherein said race is of metallic material and is embedded in the wearing material of said collars.

27. The eccentric worm pump as defined in claim 1 wherein said rotor is comprised of individual cylindrical rotor disks with thickness adapted substantially to the collar width; each disk being rotatably shifted relative to the adjacent side by a constant index angle.

28. The eccentric worm pump as defined in claim 27 including a cylindrical shaft for seating said rotor disks with an eccentric bore; said rotor disks being seated in the rotor axis and being coupled in the direction of rotation with said cylindrical shaft.

29. The eccentric worm pump as defined in claim 28 including an internal key head between said rotor disks and said shaft, said shaft having a helical keyway, said rotor disks engaging said helical keyway by way of an internal key head.

30. The eccentric worm pump as defined in claim 27 wherein said stator is comprised of stator disks, said rotor and stator disks and said collars having substantially equal widths.

31. The eccentric worm pump as defined in claim 30 wherein said collars are mounted on the rotor disks and have cylindrical inside and outside surfaces.

32. The eccentric worm pump as defined in claim 30 including a shaft concentric with the rotor axis; ribs and grooves uniformly distributed over the periphery of said shaft and having a multiple-edge profile for holding the rotor disks.

33. The eccentric worm pump as defined in claim 32 wherein said multiple-edge profile is helically-shaped and has the same pitch as the rotor helix.

34. The eccentric worm pump as defined in claim 32 wherein said multiple-edge profile is substantially parallel to the rotor axis, the spacing of said ribs and grooves being equal substantially to the ratio of disk width to the pitch.

35. The eccentric worm pump as defined in claim 1 including individual elliptical wearing rings attached to the inside surface of said stator sleeve.

36. The eccentric worm pump as defined in claim 35 wherein said wearing rings are located in inwardly opened grooves of said stator sleeve.

37. The eccentric worm pump as defined in claim 35 wherein said stator sleeve comprises individual annular stator disks staggered relative to one another by an index angle and comprising further alternately first stator disks with a substantially smaller perforation and second stator disks with a substantially larger elliptical perforation and holding said wearing rings.

38. The eccentric worm pump as defined in claim 37 wherein said first stator disks have wearing material on at least their inside.

39. The eccentric worm pump as defined in claim 37 wherein said wearing rings are braced in the plane of said second stator disks between said first stator disks.

* * * * *